US009518740B2

(12) United States Patent
Biagioli et al.

(10) Patent No.: US 9,518,740 B2
(45) Date of Patent: Dec. 13, 2016

(54) AXIAL SWIRLER FOR A GAS TURBINE BURNER

(71) Applicant: ALSTOM Technology Ltd, Baden (CH)

(72) Inventors: Fernando Biagioli, Fislisbach (CH); Naresh Aluri, Ennetturgi (CH); Madhavan Narasimhan Poyyapakkam, Rotkreuz (CH); Jan Cerny, Fahrwangen (CH)

(73) Assignee: GENERAL ELECTRIC COMPANY GMBH, Baden (CH)

( * ) Notice: Subject to any disclaimer, the term of this patent is extended or adjusted under 35 U.S.C. 154(b) by 598 days.

(21) Appl. No.: 13/937,482

(22) Filed: Jul. 9, 2013

(65) Prior Publication Data

US 2014/0013764 A1 Jan. 16, 2014

(30) Foreign Application Priority Data

Jul. 10, 2012 (EP) ..... 12175697

(51) Int. Cl.

| | |
|---|---|
| ***F23R 3/14*** | (2006.01) |
| ***F23R 3/28*** | (2006.01) |
| ***F23C 7/00*** | (2006.01) |

(52) U.S. Cl.

CPC ..... *F23R 3/14* (2013.01); *F23C 7/004* (2013.01); *F23R 3/286* (2013.01)

(58) Field of Classification Search

CPC ..... F23R 13/14; F23R 3/286; F23C 7/004; F23C 2900/03004; F23C 2900/007001

See application file for complete search history.

(56) References Cited

U.S. PATENT DOCUMENTS

| | | | | |
|---|---|---|---|---|
| 5,351,477 | A | 10/1994 | Joshi et al. | |
| 5,647,200 | A | 7/1997 | Althaus | |
| 6,141,967 | A | 11/2000 | Angel et al. | |
| 7,878,001 | B2 * | 2/2011 | Ishizaka | F23R 3/286 431/182 |
| 8,925,323 | B2 * | 1/2015 | Zuo | F23R 3/14 60/737 |
| 2007/0042307 | A1 | 2/2007 | Marcos et al. | |

(Continued)

FOREIGN PATENT DOCUMENTS

| | | |
|---|---|---|
| DE | 44 06 399 | 10/1994 |
| DE | 10 2007 004 394 | 10/2007 |

(Continued)

OTHER PUBLICATIONS

Office Action (Decision on Grant a Patent for Invention) issued on Aug. 14, 2015, by the Russian Patent Office in corresponding Russian Patent Application No. 2013130759/06(045995), and an English Translation of the Office Action. (14 pages).

*Primary Examiner* — Arun Goyal
(74) *Attorney, Agent, or Firm* — Buchanan Ingersoll & Rooney PC

(57) ABSTRACT

An axial swirler for a gas turbine burner includes a vane ring with a plurality of swirler vanes circumferentially distributed around a swirler axis. Each of the swirler vanes includes a trailing edge. In order to achieve a controlled distribution of the exit flow velocity profile and/or the fuel equivalence ratio in the radial direction. The trailing edge is discontinuous with the trailing edge having a discontinuity at a predetermined radius.

20 Claims, 6 Drawing Sheets

(56) References Cited

U.S. PATENT DOCUMENTS

| | | | | |
|---|---|---|---|---|
| 2008/0070176 | A1 | 3/2008 | Steinbach et al. | |
| 2009/0056336 | A1 | 3/2009 | Chila et al. | |
| 2009/0139236 | A1* | 6/2009 | Yilmaz | F23R 3/286 60/737 |
| 2009/0183511 | A1 | 7/2009 | Dinu | |
| 2010/0326079 | A1* | 12/2010 | Zuo | F23R 3/286 60/748 |
| 2012/0125004 | A1 | 5/2012 | Parsania et al. | |

FOREIGN PATENT DOCUMENTS

| | | |
|---|---|---|
| EP | 2 233 836 | 9/2010 |
| JP | H09-079088 | 3/1997 |
| JP | 2006-336997 | 12/2006 |
| JP | 2010-159951 | 7/2010 |
| JP | 2011-080669 | 4/2011 |
| JP | 2012-237548 | 12/2012 |
| RU | 2 107 535 C1 | 3/1998 |
| RU | 2 187 043 C1 | 8/2002 |
| RU | 2 439 430 C1 | 1/2012 |
| SU | 566942 A1 | 7/1977 |

* cited by examiner

AXIAL SWIRLER FOR A GAS TURBINE BURNER

CROSS-REFERENCE TO RELATED APPLICATIONS

This application claims priority to European Application 12175697.7 filed Jul. 10, 2012, the contents of which are hereby incorporated by reference in its entirety.

TECHNICAL FIELD

The present invention relates to the technology of gas turbines. It refers to an axial swirler for a gas turbine burner according to the preamble of claim 1.

BACKGROUND

Axial annular swirlers are commonly used to create of vortex flow resulting in a central reverse flow region for stabilization of flames in gas turbine combustors.

FIG. 1 shows a typical swirler arrangement 10. A cylindrical air tube guides an incoming air flow 18 along a longitudinal axis 11 through a swirler section comprising a swirler 14 with a plurality of swirler vanes 19, into a mixing tube 16, where the rotating air flow is mixed with a fuel that is injected by means of fuel injector at the end of a fuel lance 13. The air-fuel mixture then enters a combustion chamber 17 to feed a stabilized flame therein.

Increasing demand on pollution-reduced combustion of conventional fuels as well as hydrogen rich fuels are driving the technical development towards limits of combustion of very lean homogeneously premixed mixtures. The limiting factor in practical combustors is, with the increasing mixture homogeneity, the increasingly strong coupling of the dynamics of the combustion process with the combustor thermoacoustic oscillations.

The stability of the flame, in terms of degree of amplification of the acoustic oscillations, can be improved by optimization of the swirler aerodynamics and the radial profile of the unmixedness of the combustible mixture, entering the flame. Further, the stability and operability of the combustor can be improved by combination of the stabilization by reverse flow, created by the annular swirler with reverse flow in the wake of a bluff body, placed in the centre of the annular swirler.

A pollution-reduced combustion is however not the only demand on the burner. Resistance against flame flash back into the burner along the burner walls is an absolute requirement and low pressure drop of the combustion system, where the swirler can significantly contribute, is important for the gas turbine efficiency.

Document DE 44 06 399 A1 discloses a device for improving fuel-air mixing in re-heat combustors. An annular flow channel of this combustor is limited by a cylindrical interior wall and a cylindrical exterior wall. Both walls are connected by a number of streamlined supports, which are evenly distributed at the circumference and act as guide vanes. The trailing edges of these guide vanes feature a discontinuity, by a notch they are divided into two diverging portions. The radially outer rear half of the guide vane has an uninterrupted profiling of the underpressure surface and the overpressure surface, while the radially inner rear half is directed offset in relation to this, i.e. the profile of the overpressure surface makes a transition into the underpressure surface. By this measure the hot gas flow through the annular passage is split into two diverging partial flows. The vortices generated by the diverging portions of the guide vanes accelerate the mixture of fuel and combustion air and additionally smooth out the concentration and temperature differences in the gas flow.

Document DE 10 2007 004 394 A1 relates to a premixing burner for a gas turbine. In an annular flow channel a swirler for generating a fuel-air-mixture is arranged. The swirler is equipped with streamlined guide vanes. In an inner portion near by the interior wall of the flow channel the trailing edges of these swirler vanes have a recess forming a gap between the airfoil and the interior wall. This discontinuity at the radially inner rear portion supports the generation of tip vortices capable of enhancing premixing.

Document EP 2 233 836 A1 discloses a swirl generator, which has outer wall enclosing central fuel distributor and bounding axial flow channel for combustion air. Swirl vanes extend in radial direction to outer wall to give tangential flow component to flowing combustion air. A separating wall encloses central fuel distributor, and is positioned radially within outer wall to divide flow channel into radially inner channel segment and radially outer channel segment. The radially inner channel segment allows combustion air to pass without giving tangential flow component to combustion air.

Document US 2009/056336 A1 relates to a burner for use in a combustion system of an industrial gas turbine. The burner includes a fuel/air premixer including a splitter vane defining a first, radially inner passage and a second, radially outer passage, the first and second passages each having air flow turning vane portions which impart swirl to the combustion air passing through the premixer. The vane portions in each passage are commonly configured to impart a same swirl direction in each passage. A plurality of splitter vanes may be provided to define three or more annular passages in the premixer.

Document US 2009/183511 A1 discloses a fuel nozzle for a combustor of a gas turbine engine including a nozzle inlet, a combustion area and a swirler disposed between the nozzle inlet and combustion area. The swirler includes a plurality of swirler vanes, each swirler vane capable of creating a pressure difference in fluid flow through the swirler between a pressure side and suction side of the swirler vane. The swirler further includes at least one through airflow hole located in at least one swirler vane of the plurality of swirler vanes. The at least one through airflow hole is capable of utilizing the pressure difference between the pressure side and suction side to promote fluid flow through the at least one airflow hole. Also disclosed is a method for operating a combustor.

Document US 2012/125004 A1 teaches a combustor premixer, which includes a burner tube having a bell mouth-shaped opening, a plurality of tubular bodies telescopically disposed within the burner tube to deliver combustible materials to a premixing passage defined between the burner tube and an outermost one of the plurality of tubular bodies and a plurality of swirler vanes arrayed circumferentially in the opening, each one of the plurality of swirler vanes including a body extending along a radial dimension from the burner tube to the outermost tubular body and a leading edge protruding upstream from the opening.

SUMMARY

It is an object of the present invention to provide an axial swirler for a gas turbine burner, which allows creation of an optimal exit flow velocity profile for increased combustion stability.

This and other objects are obtained by an axial swirler according to claim 1.

The Invention relates to an axial swirler for a gas turbine burner, comprising a vane ring with a plurality of swirler vanes, circumferentially distributed around a swirler axis, and the vanes extending in radial direction between an inner radius and an outer radius, each of said swirler vanes comprising a trailing edge.

It is characterized in that, in order to achieve a controlled distribution of the exit flow velocity profile and/or the fuel equivalence ratio in the radial direction, said trailing edge is discontinuous with the trailing edge having a discontinuity at a predetermined radius, wherein at the inner radius of the vane the angle between the tangent to the camber line of the vane at the trailing edge and the swirler axis is between 0° and 30°, from this inner radius the angle is linearly increasing to a value of between 30° and 60° at the predetermined radius, and from this predetermined radius the angle is linearly decreasing to a value of between 10° and 40° at the outer radius of the vane.

According to a preferred embodiment the angle between the tangent to the camber line of the vane and the swirler axis is between 10° and 28°, from this inner radius the angle is linearly increasing to a value of between 35° and 50° at the predetermined radius, and from the predetermined radius the angle is linearly decreasing to a value of between 20° and 40° at the outer radius of the vane.

According to another embodiment of the invention said predetermined radius has a value of between 20% and 80% of the difference between the outer radius and the inner radius.

The discontinuous trailing edge, formed in this way, generates two different types of downstream flow each with a predetermined flow velocity profile in the swirling flow at the exit of the swirler. Starting from the inner radius of the vane the angle ( ) between the camber line and the swirl axis at the trailing edge increases with increasing radius until a predetermined radius is reached. This design effects a jet like axial velocity distribution in the downstream flow. And the decreasing angle between camber line and swirl axis in the outer region of the vane serves to level off the axial velocity distribution above flashback values.

Specifically, said predetermined flow velocity profiles of the two flow types do not mix with each other and therefore allow for a controlled distribution of fuel equivalence ratio in the radial direction.

According to another embodiment of the invention said swirler vanes are provided with a predetermined stall for generating an increased turbulence in the flow behind the stalled swirler vane.

According to just another embodiment of the invention fuel injection means are provided on the trailing edge of the vanes.

According to a further embodiment of the invention said swirler vanes have a suction side and a pressure side, and that fuel injection means are provided on the suction side.

According to just another embodiment of the invention said swirler vanes have a suction side and a pressure side, and that fuel injection means are provided on the pressure side.

The axial swirl burner according to the invention allows avoiding excessive reduction of the axial velocity at the inner radius by flattening the axial velocity distribution close to the maximum, i.e. outer radius. According to the invention this is obtained by a swirler whose exit flow angle, i.e. angle between the tangent to the camber line an the flow rotational axis is linearly increasing with the radius up to a predetermined radius, and then, from this radius decreasing as 1/R (which effects the flat axial velocity distribution).

BRIEF DESCRIPTION OF THE DRAWINGS

The present invention is now to be explained more closely by means of different embodiments and with reference to the attached drawings.

DETAILED DESCRIPTION

The influence of swirler design parameters (as for example vane shape, e.g. flat or curved, vane outlet angle, aspect ratio (vane height to vane chord length), number of vanes) on the characteristic of the downstream reverse flow region has been so far mainly investigated experimentally.

The target was a design of a swirler with a downstream mixing tube having a high mass flow-to-pressure drop characteristics with a large, highly turbulent downstream recirculation region.

Contrary to the experimental approach, the present invention is a result of a reverse process, where a prescribed ideal radial distribution of the swirl exit velocity is defined to fulfill additional requirements as:

- Flame stability and combustion dynamics;
- Controlled fuel equivalence ratio and mixture homogeneity in radial direction;
- Flash back resistance;
- Possibility for radial staging (controlled variation of equivalence ratio between inner and outer part of the swirling flow);
- Low pressure drop of the swirler;
- Injection of gaseous fuel from the pressure and/or suction side of the swirler vane airfoil;
- Iso-streamlined injection of highly reactive H2 rich fuels from the trailing edge of the airfoil;
- Zero radial component of the swirler exit flow field on the swirler outer diameter before entering the mixing tube;
- Controlled stalled regions, attached to the vanes for creation of striations of turbulence for improvement of the combustion stability.

Figure 1:
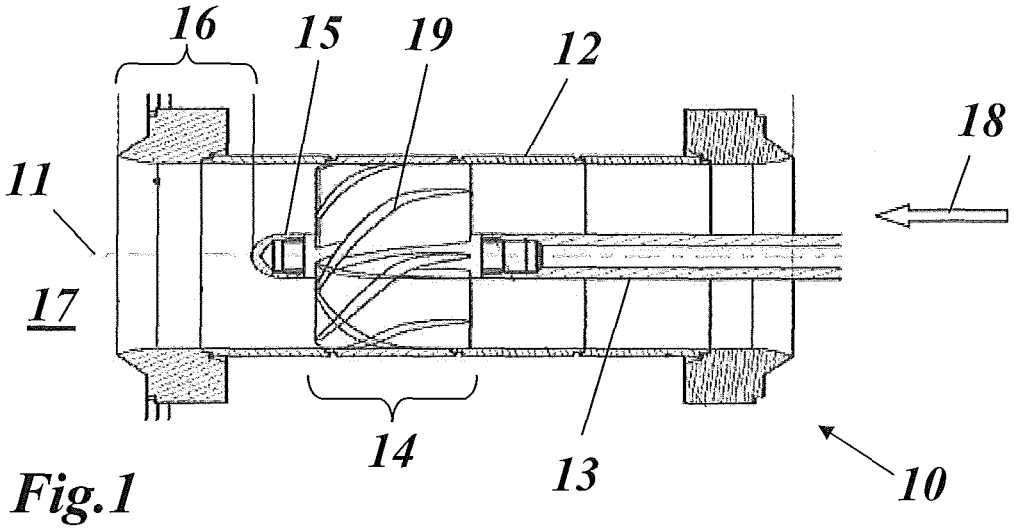
FIG. 1 shows a longitudinal section through a typical axial swirler arrangement.
Figure 2:
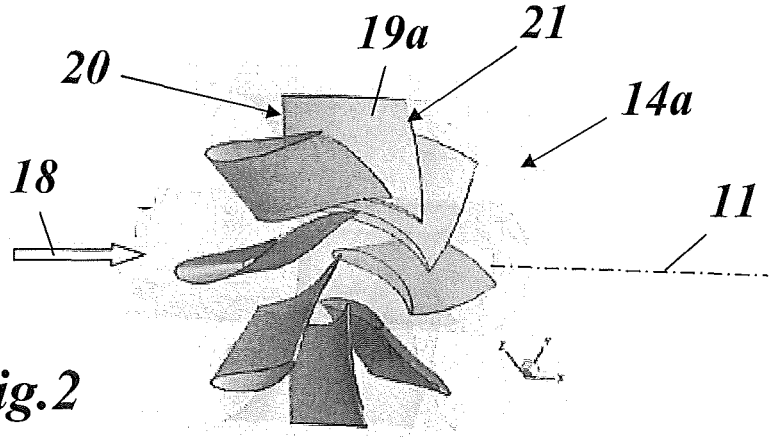
FIG. 2 shows a first swirler with a first vane shape with a smooth trailing edge.
Figure 3:
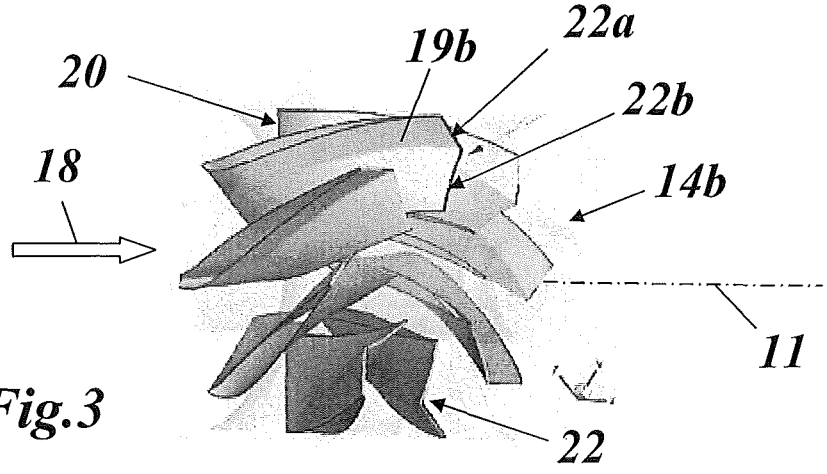
FIG. 3 shows a second swirler with a second vane shape with a discontinuous trailing edge.
Figure 4:
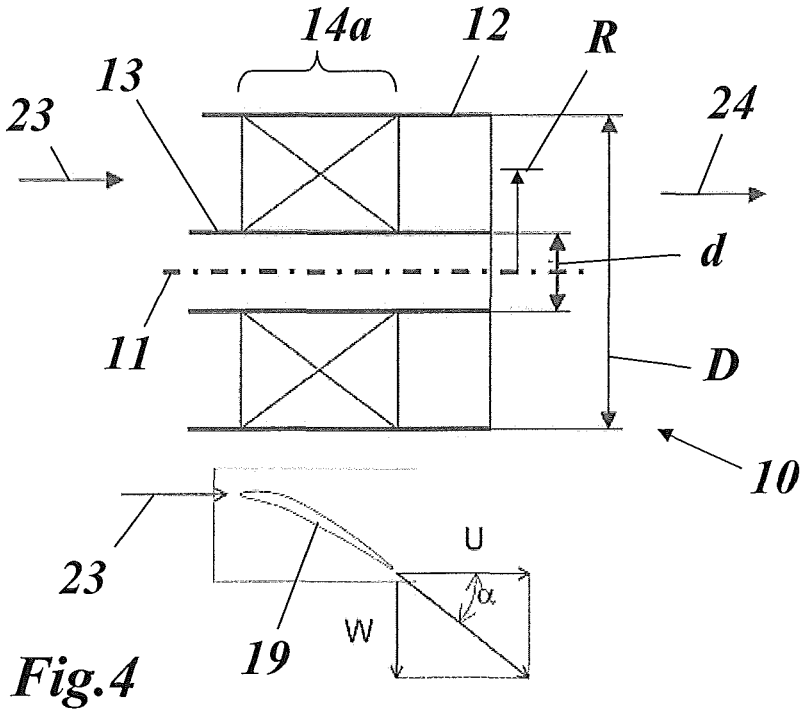
FIG. 4 shows the principal geometry of an axial swirler arrangement with smooth vane trailing edge.

FIGS. 2 and 3 show a sketch of two different swirlers 14*a* and 14*b* with different shapes of their swirler vanes 19*a*, 19*b* for two different prescribed exit flow profiles:

The axial swirler 14*a* of FIG. 2 comprises swirler vanes 19*a* with a leading edge 20 and a smooth trailing edge 21, i.e. without radial staging of the discharge flow field. The geometry of such a swirler is shown in FIG. 4, where 23 references the inflow and 24 references the effusion, d is the outer diameter of the fuel lance 13 and D is the inner diameter of the air tube 12 (and mixing tube, respectively).

The relation between tangential component W and axial component U of the flow velocity at the swirler exit (FIG. 4) has been chosen so that the axial velocity profile is "flat"; it means the axial component U is ideally constant over the swirl radius R (the radial velocity component is zero). As has been said before, line of the vane trailing edge 21 is in this case continuously smooth (unbroken).

Figure 6:
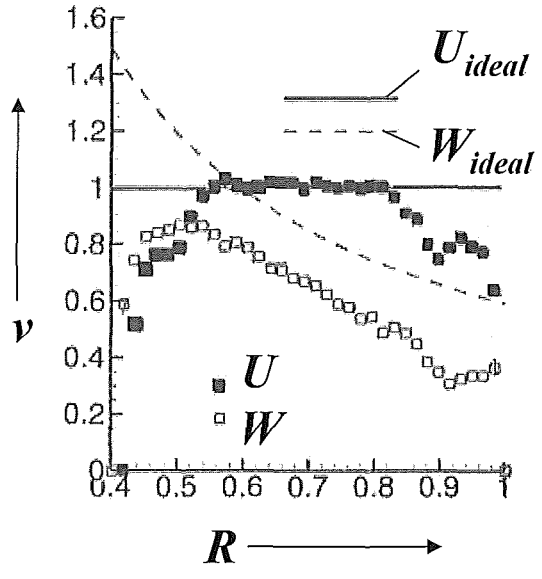
FIG. 6 shows the velocity distribution downstream of the swirler for a swirler geometry according to FIG. 4.

The exit velocity profile of such an unstaged swirler, which is designed for an ideal flat axial velocity profile U, is shown in FIG. 6, where the dashed curve is the ideal W-profile, the continuous curve is the ideal U-profile, and the hollow and full squares are the respective measured velocities, all in their dependence on the radius R.

Figure 5:
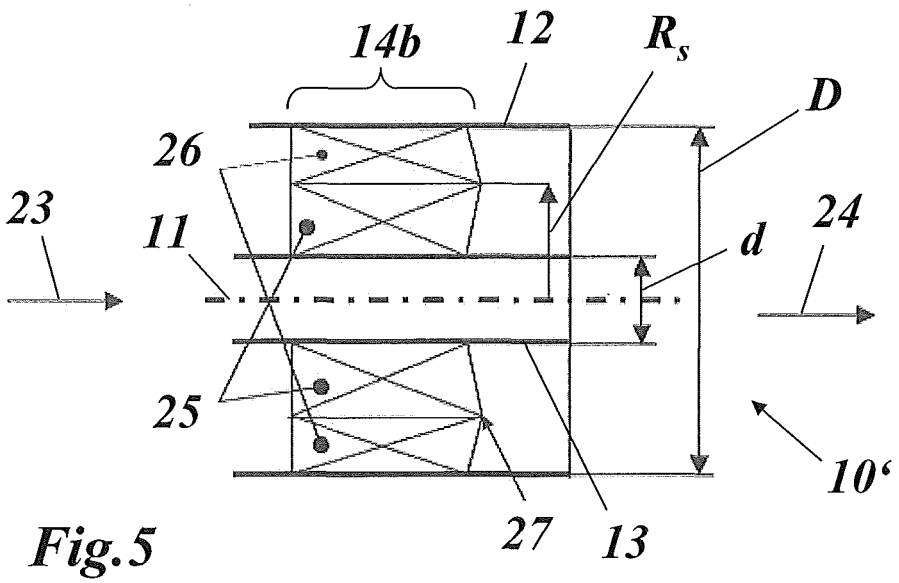
FIG. 5 shows the principal geometry of an axial swirler arrangement with a discontinuous vane trailing edge.

The axial swirler 14*b* of FIG. 3 represents a staged axial swirler with radial staging of the discharge flow field by means of a discontinuous trailing edge 22, which is subdivided into two trailing edge sections 22*a* and 22*b* of different orientation. The geometry of such a swirler is shown with the swirler arrangement 10' in FIG. 5, where 25 references a first (inner) flow type and 26 references a second (outer) flow type, with the splitting radius $R_s$ separating both flow type regimes (and trailing edge sections 22*a* and 22*b*) at a discontinuity 27.

Figure 7:
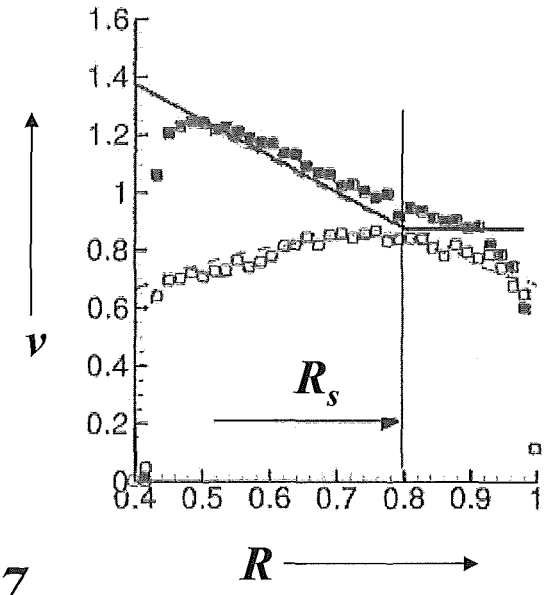
FIG. 7 shows the velocity distribution downstream of the swirler for a swirler geometry according to FIG. 5.

For the first flow type 25 (with $R<R_s$) $\tan\alpha=W/U\sim R$ resulting in an approximately constant W and decreasing U with increasing R. For the second flow type 26 (with $R>R_s$) $\tan\alpha=W/U\sim 1/R$ resulting in decreasing W and constant U with increasing R (see FIG. 7).

Thus, the relation between tangential component W and axial component U at the swirler exit in this case has been chosen so that the tangential velocity W is "flat" in the inner region (then, U is decreasing) while the opposite takes place in the outer region ("flat" axial velocity U and decreasing tangential velocity W). This requires a discontinuous line of the vane trailing edge 22. The radial component of the flow in both sections is V=0, which means ideally no mixing between the two different types of flow.

Figure 8:
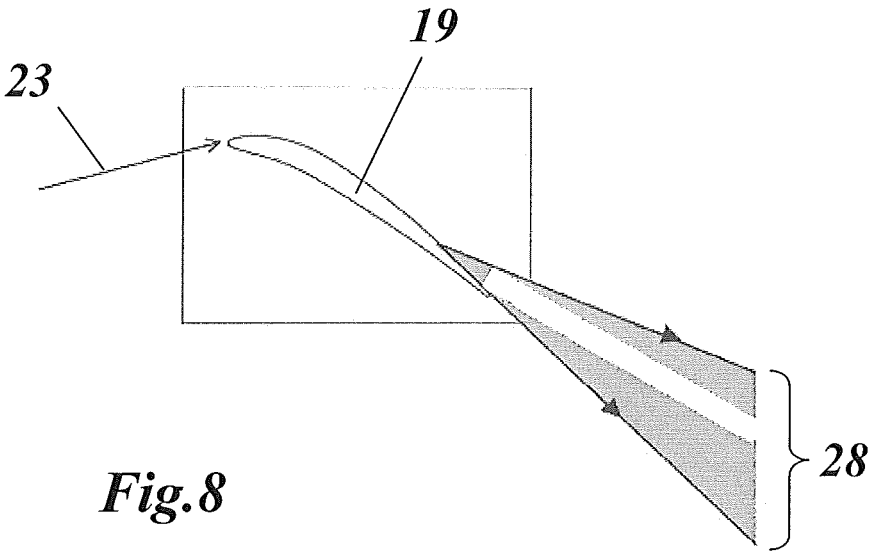
FIG. 8 shows a swirler vane type with controlled stall for increasing the turbulent flow.

Furthermore, the vanes 19*a*, 19*b* can be designed to have a controlled, predetermined stall (see FIG. 8), where—due to the stall—a region 28 of increased turbulence is generated in the flow behind the stalled swirler vane 19 and approaching the flame front. The predetermined stall is applicable to vanes with and without discontinuous trailing edge.

Figure 9:
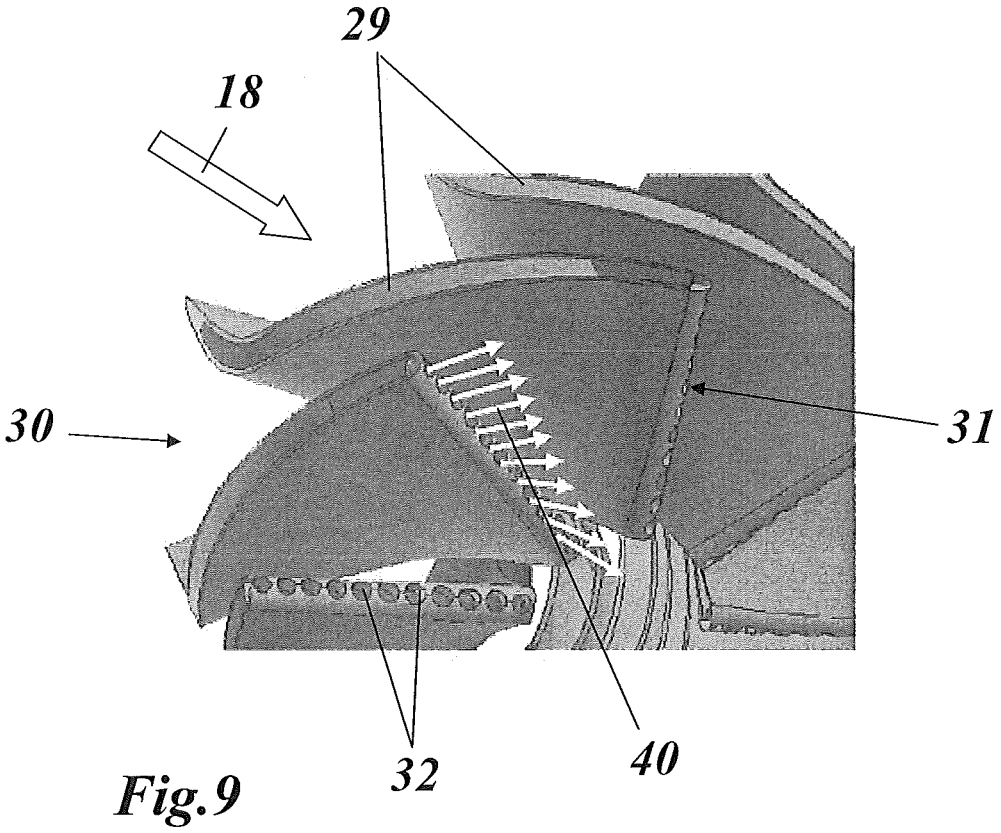
FIG. 9 shows the principle of an iso-streamlined fuel injection from the trailing edge of the swirler vane.

Another way to improve the swirler performance is an iso-streamlined fuel injection from the trailing edge of the swirler vane, as shown in FIG. 9. The swirler 30 of FIG. 9 has swirler vanes 29, the trailing edges of which are provided with rows of fuel injection ports 32, which emit fuel beams 40 with an appropriate beam direction. The fuel injection at the trailing edge is applicable to vanes with and without discontinuity at the trailing edge.

Figure 10:
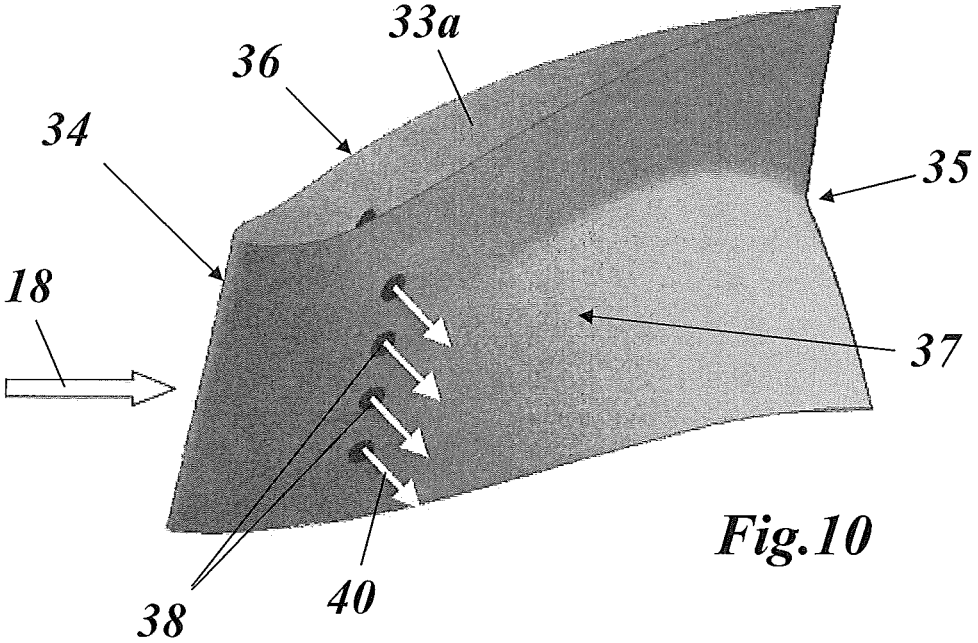
FIG. 10 shows fuel injection on the suction side of the swirler vane.

A further way of improving the performance is a fuel injection at the sides of the swirler vanes. According to FIG. 10, swirler vanes 33*a* with a leading edge 34 and a discontinuous trailing edge 35 and a suction side 36 and pressure side 37 extending between the two edges 34, 35 are provided with a row of fuel injection ports 38 arranged on the suction side 36 of the vane.

Figure 11:
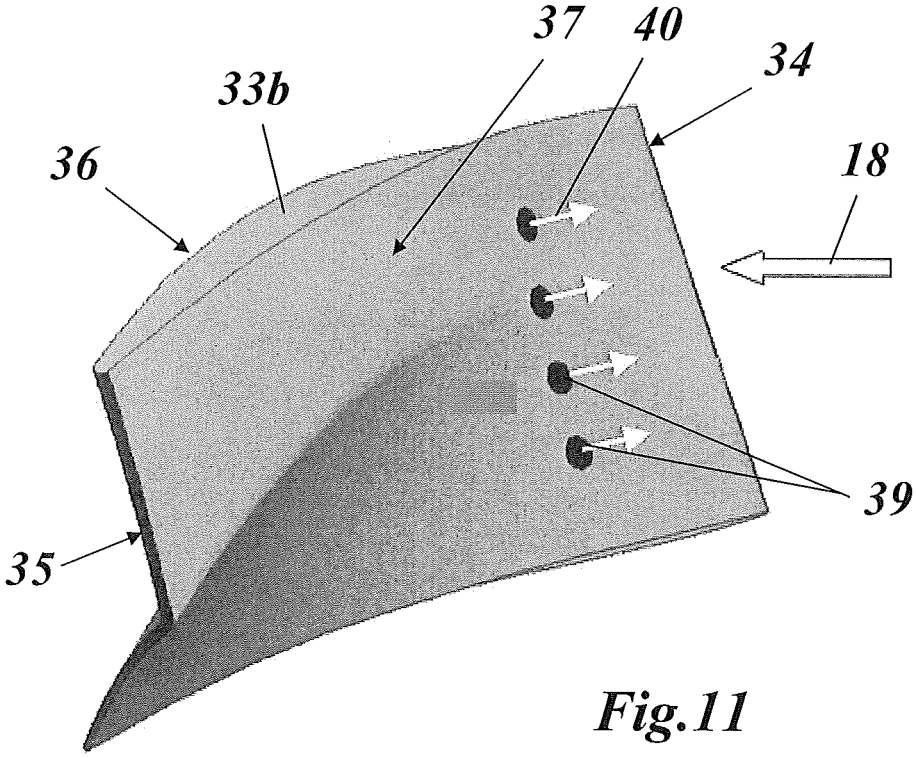
FIG. 11 shows fuel injection on the pressure side of the swirler vane.

According to FIG. 11, swirler vanes 33*b* with a leading edge 34 and a discontinuous trailing edge 35 and a suction side 36 and pressure side 37 extending between the two edges 34, 35 are provided with a row of fuel injection ports 39 arranged on the pressure side 37 of the vane.

Figure 12:
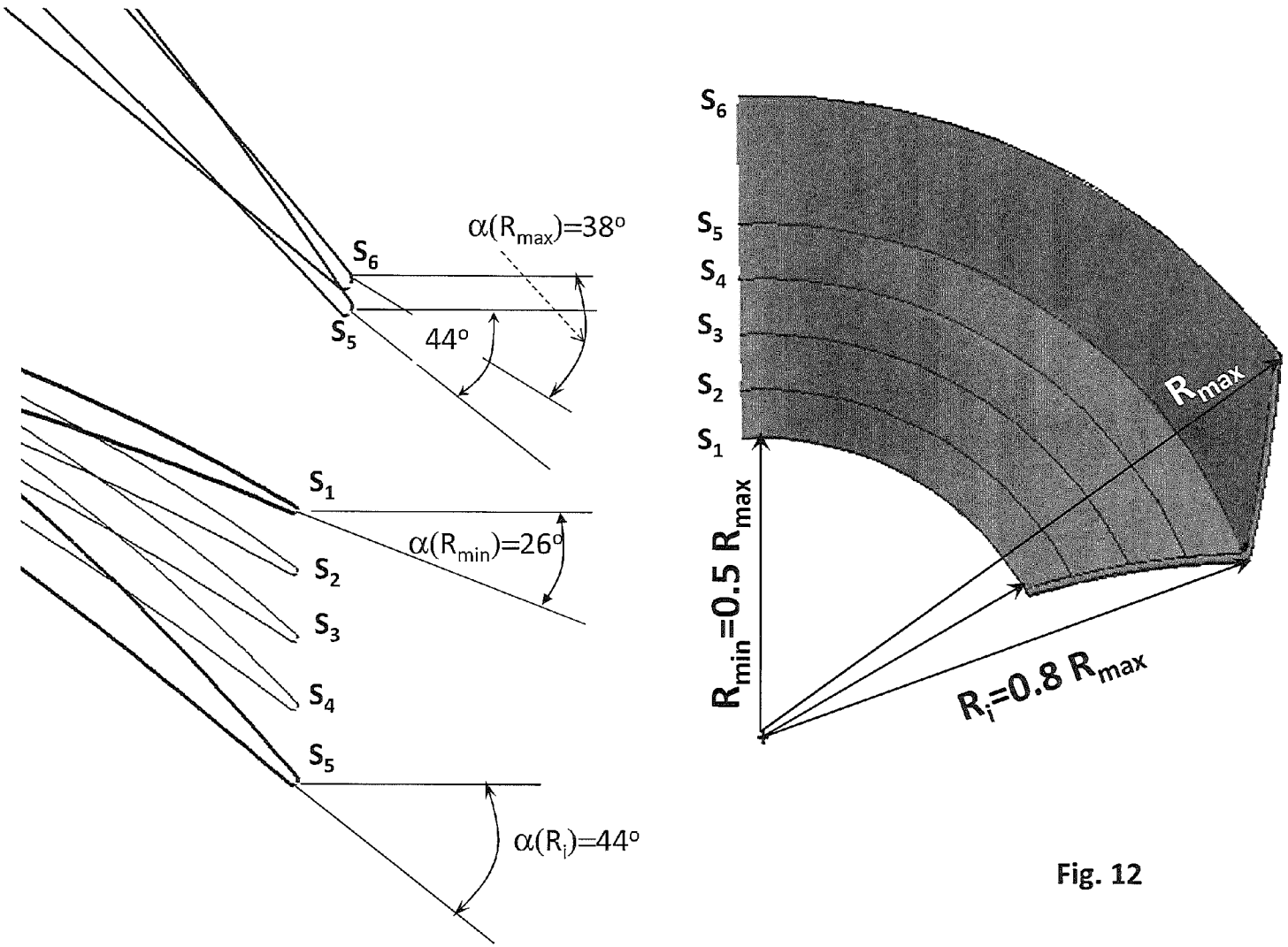
FIG. 12 shows in an embodiment the radial distribution of the exit flow angle of a swirler vane according to the invention.

FIG. 12 shows by way of example the radial distribution of the angle α between the tangent to the camber line at the trailing edge 21, 22, 35 of the swirler vane 19, 29, 33 and the swirler axis 11. At its inner radius ($R_{min}$) the exit flow angle α has a value of α=26°. With increasing radius R the angle α linearly increases to a maximum value of α=44° at the predetermined radius $R_s$, whereby $R_s=0.8\ R_{max}$.

From the radius Rs to the outer radius $R_{max}$ of the swirler vane 19, 29, 33 the angle α is linearly decreasing to a value of α=38° at the outer radius of the vane 19, 29, 33.

According to the invention, there is a high flexibility to shape the exit flow velocity flow field and distribution of fuel equivalence ratio, a low pressure drop, and a compact design.

The characteristics of the new swirler design are:

- The axial swirler is designed for controlled distribution of the exit flow velocity profile and fuel equivalence ratio;
- Shaped swirler vanes with a discontinuous trailing edge are provided as result of two different prescribed types of flow velocity profile in the swirling flow at the exit;
- The splitting radius dividing the two stages and flow types can vary from 20% to 80% of the annulus height;
- Any exit flow angle at minimum, intermediate and maximum radius is possible.
- Shaped swirler vanes with a discontinuous trailing edge are provided as result of two different prescribed types of flow velocity profile at the exit, which do not mix with each other and therefore allow for a controlled distribution of fuel equivalence ratio in the radial direction;
- The swirler vanes can be shaped with aerodynamically optimal vane profile for reduction of pressure losses;
- The swirler vanes can be shaped/designed with a controlled stall for creation of a controlled turbulence;
- Fuel injection ports can be provided on the suction and/or pressure side of the vanes; and
- Iso-streamlined fuel injection can be provided on the trailing edge of the vanes.

The invention allows the creation of an optimal exit flow velocity profile for increased combustion stability.

A high axial flow velocity near the wall eliminates the risk of flash back along the wall.

A control of the radial distribution of the fuel equivalence ratio in the radial direction (fuel staging) is achieved.

What is claimed is:

1. An axial swirler for a gas turbine burner, the axial swirler comprising:

a vane ring with a plurality of swirler vanes circumferentially distributed around a swirler axis and extending in a radial direction between an inner radius and an outer radius, each of said swirler vanes comprising a trailing edge that extends between the inner radius and the outer radius of the swirler vane, the trailing edge configured to define a controlled distribution of an exit flow velocity profile and/or a fuel equivalence ratio in the radial direction, wherein said trailing edge is discontinuous with the trailing edge having a discontinuity at a predetermined radius to define an apex of the trailing edge, a first segment of the trailing edge extending from the inner radius to the apex and a second segment of the trailing edge extending from the apex to the outer radius, wherein the trailing edge is configured so that at the inner radius an exit flow angle of fluid passing along the swirler vane between a tangent to a camber line of the swirler vane and a swirler axis is between 0° and 30°, the exit flow angle is linearly increasing to a value of between 30° and 60° from the inner radius to the predetermined radius, and the exit flow angle is linearly decreasing to a value of between 10° and 40° from the predetermined radius to the outer radius.

2. The axial swirler according to claim 1, wherein the trailing edge is configured so that the exit flow angle at the inner radius is between 10° and 28°, the exit flow angle from the inner radius to the predetermined radius is linearly increasing to a value of between 35° and 50° at the predetermined radius, and from the predetermined radius to the outer radius is linearly decreasing to a value of between 20° and 40° at the outer radius.

3. The axial swirler according to claim 1, wherein the trailing edge is configured so that the exit flow angle at the inner radius is between 24° and 28°, the exit flow angle from the inner radius to the predetermined radius is linearly increasing to a value of between 42° and 46°, and the exit flow angle from the predetermined radius to the outer radius is linearly decreasing to a value of between 36° and 38° at the outer radius.

4. The axial swirler according to claim 1, wherein the trailing edge linearly extends from the inner radius to the predetermined radius and the trailing edge linearly extends from the predetermined radius to the outer radius of the swirler vane, the discontinuity at the predetermined radius defining the apex being a point at which the trailing edge extends farthest away from a leading edge of the swirler vane that is opposite the trailing edge of the swirler vane.

5. The axial swirler according to claim 1, wherein said predetermined radius has a value of between 20% and 80% of a difference between the outer radius and the inner radius.

6. The axial swirler according to claim 1, wherein said discontinuous trailing edge is formed as a result of two different prescribed types of flow, each with a predetermined flow velocity profile in a swirling flow at an exit of the axial swirler, wherein the first segment of the trailing edge between the inner radius and the predetermined radius is configured to generate a jet like axial velocity distribution and the second segment of the trailing edge between said predetermined radius and the outer radius is configured to level off the axial velocity distribution above flashback values.

7. The axial swirler according to claim 6, wherein said predetermined flow velocity profiles of the two flow types do not mix with each other and therefore allow for a controlled distribution of the fuel equivalence ratio in the radial direction.

8. The axial swirler according to claim 1, wherein said swirler vanes have a suction side and a pressure side, and at least one fuel injector is on the pressure side.

9. The axial swirler according to claim 1, wherein the trailing edge is configured so that a relationship between a tangential flow component of a flow of the fluid at an exit of the swirler vane and an axial flow component of the flow of the fluid at the exit of the swirler vane is defined by the swirler vane so that the tangential flow component is flat from the inner radius to the predetermined radius and the axial flow component is decreasing from the inner radius to the predetermined radius and the axial flow component is flat from the predetermined radius to the outer radius at the exit of the swirler vane and the tangential flow component is decreasing from the predetermined radius to the outer radius at the exit of the swirler vane.

10. The axial swirler according to claim 9, wherein the trailing edge is configured so that the flow of the fluid has a radial flow component that is 0 such that there is no mixing of the fluid between an inner section of the flow of the fluid and an outer section of the flow of the fluid.

11. The axial swirler according to claim 1, wherein the trailing edge is configured so that a relationship between a tangential flow component of a flow of the fluid at an exit of the swirler vane and an axial flow component of the flow of the fluid at the exit of the swirler vane is defined by the swirler vane so that the tangential flow component is unchanging from the predetermined radius to the inner radius and the axial flow component is decreasing from the predetermined radius to the inner radius and the axial flow component is unchanging from the predetermined radius to the outer radius at the exit of the swirler vane and the tangential flow component is decreasing from the predetermined radius to the outer radius at the exit of the swirler vane.

12. The axial swirler according to claim 11, wherein the trailing edge is configured so that the flow of the fluid has a radial flow component that is 0 such that there is no mixing of the fluid between an inner section of the flow of the fluid passing along the inner radius and an outer section of the flow of the fluid passing along the outer radius.

13. The axial swirler according to claim 12, wherein the swirler vane is configured to define a predetermined stall at a region of increased turbulence in the flow of the fluid approaching a flame front.

14. The axial swirler according to claim 12, wherein at least one row of fuel injection ports are defined in the trailing edge.

15. The axial swirler according to claim 14, wherein the at least one row of the fuel injection ports comprise at least one of:

- a row of the fuel injection ports on a suction side extending between a leading edge of the swirler vane and the trailing edge of the swirler vane; and
- a row of the fuel injection ports on a pressure side of the trailing edge extending between the leading edge and the trailing edge.

16. The axial swirler of claim 12, wherein the trailing edge has a splitting radius configured to divide the flow of the fluid into the inner section of the flow of the fluid and the outer section of the flow of the fluid.

17. The axial swirler of claim 16, wherein the splitting radius is located at the discontinuity defined in the trailing edge.

18. A method of using an axial swirler for a gas turbine burner, the axial swirler comprising a vane ring with a plurality of swirler vanes circumferentially distributed around a swirler axis and extending in a radial direction between an inner radius and an outer radius, each of said swirler vanes comprising a trailing edge configured to define a controlled distribution of an exit flow velocity profile and/or a fuel equivalence ratio in the radial direction, the trailing edge extending between the inner radius and the outer radius of the swirler vane opposite a leading edge of the swirler vane, wherein said trailing edge is discontinuous with the trailing edge having a discontinuity at a predetermined radius to define an apex along the trailing edge, a first segment of the trailing edge extending from the inner radius to the apex and a second segment of the trailing edge extending from the apex to the outer radius, the method comprising:

passing fluid along each of the swirler vanes such that at the inner radius of the trailing edge of the swirler vane an exit flow angle of the fluid passing along the swirler vane between a tangent to the camber line of the swirler vane and the swirler axis is between 0° and 30°, the exit flow angle is linearly increasing to a value of between 30° and 60° from the inner radius to the predetermined radius of the trailing edge, and the exit flow angle is linearly decreasing to a value of between 10° and 40° from the predetermined radius to an outer radius of the trailing edge of the swirler vane.

19. The method of claim 18, wherein the passing of the fluid occurs such that the exit flow angle of the fluid at the inner radius is between 10° and 28°, the exit flow angle of the fluid from the inner radius to the predetermined radius is linearly increasing to a value of between 35° and 50° at the predetermined radius, and the exit flow angle of the fluid from the predetermined radius to the outer radius is linearly decreasing to a value of between 20° and 40° at the outer radius.

20. The method of claim 18, wherein the passing of the fluid occurs such that the exit flow angle of the fluid at the inner radius is between 24° and 28°, the exit flow angle of the fluid from the inner radius to the predetermined radius is linearly increasing to a value of between 42° and 46°, and the exit flow angle of the fluid from the predetermined radius to the outer radius is linearly decreasing to a value of between 36° and 38° at the outer radius.

* * * * *